US006966508B2

(12) United States Patent
Levy et al.

(10) Patent No.: US 6,966,508 B2
(45) Date of Patent: Nov. 22, 2005

(54) ON-LINE CONTROL OF COAL FLOW

(76) Inventors: Edward Kenneth Levy, 1030 Raymond Ave., Bethlehem, PA (US) 18018; Harun Bilirgen, 3998 Autumn Ridge Rd., Bethlehem, PA (US) 18017; Elshabasi Ali, 6 Duh Dr., Apt. #233, Bethlehem, PA (US) 18015

( * ) Notice: Subject to any disclaimer, the term of this patent is extended or adjusted under 35 U.S.C. 154(b) by 141 days.

(21) Appl. No.: 10/743,978

(22) Filed: Dec. 23, 2003

(65) Prior Publication Data

US 2004/0188554 A1 Sep. 30, 2004

Related U.S. Application Data

(60) Provisional application No. 60/436,241, filed on Dec. 23, 2002.

(51) Int. Cl.[7] ..... B02C 15/00; B02C 23/08
(52) U.S. Cl. ..... 241/119; 241/79.1
(58) Field of Search ..... 241/119, 79.1

(56) References Cited

U.S. PATENT DOCUMENTS 5,819,947 A * 10/1998 Nardi et al. ..... 209/139.2
5,873,156 A * 2/1999 Wark ..... 29/401.1
5,957,300 A * 9/1999 Nardi et al. ..... 209/143
5,971,302 A * 10/1999 Doumet ..... 241/17

* cited by examiner

*Primary Examiner*—Derris H. Banks
*Assistant Examiner*—Faye Francis
(74) *Attorney, Agent, or Firm*—Law Offices of Royal W. Craig

(57) ABSTRACT

A system for balancing and controlling the distribution of pulverized coal into multiple equal diameter outlet pipes of coal pulverizers for improving boiler performance. The device includes a plurality of flow control elements, one flow control element for each outlet pipe, all positioned a pre-determined distance upstream of the outlet pipes. Each flow control element is mounted on an independent adjustment mechanism and is thereby adjustable in position relative its corresponding outlet pipe to selectively vary the wake of the downstream coal particulate flow relative to primary air flow. The method of the present invention is practiced by monitoring coal particulate flow at the outlet pipes relative to primary air flow or individual flame characteristics, and then compensating for noted imbalances by selectively adjusting the flow control elements, thereby balancing and controlling the distribution of coal and improving combustion efficiency.

17 Claims, 6 Drawing Sheets

Adjustable Flow Control Elements Installed Inside a Pulverizer with Four Outlet Pipes

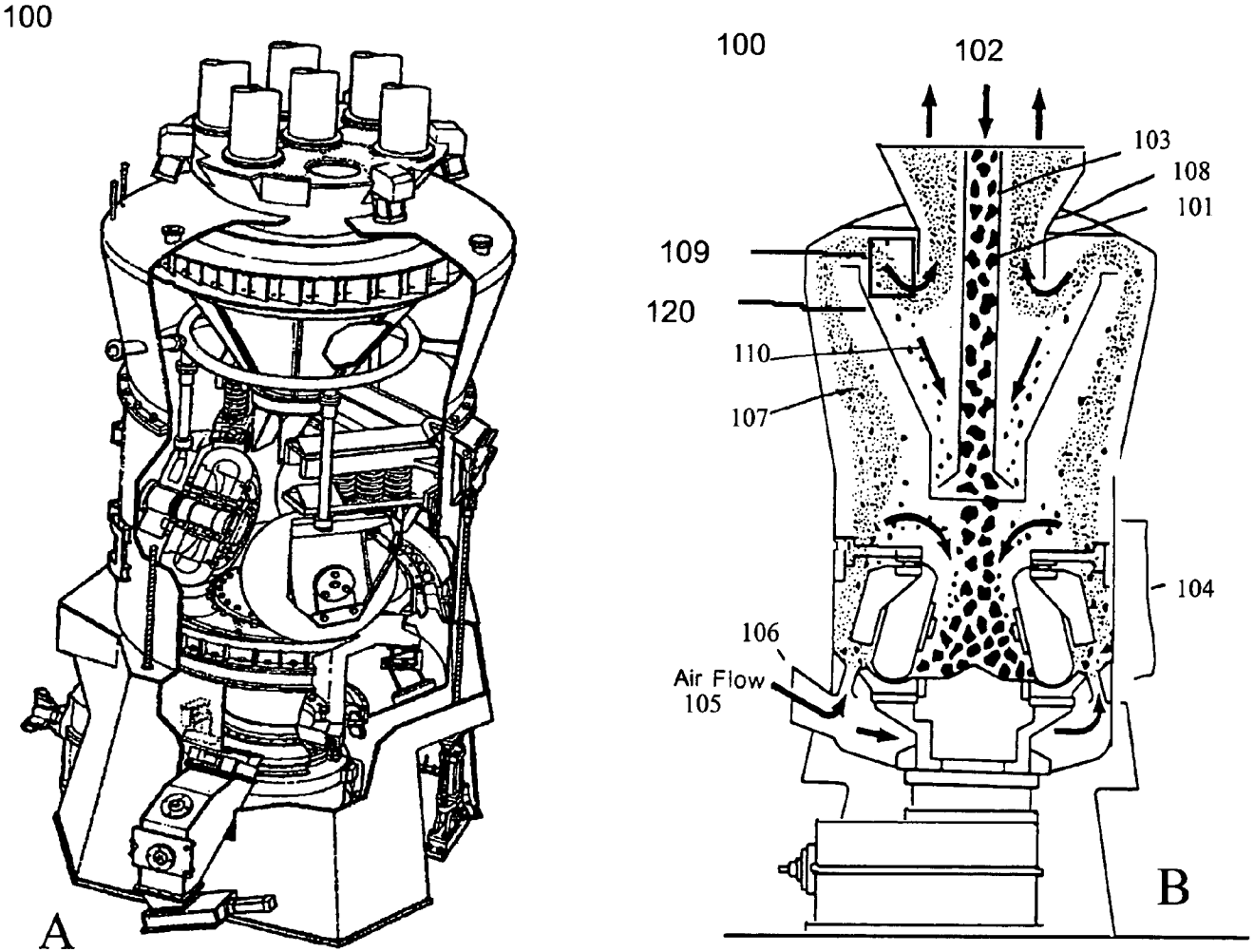
FIG 1: A Typical Pressurized Vertical Spindle Mill with 6 Outlet Pipes.
(Prior Art)

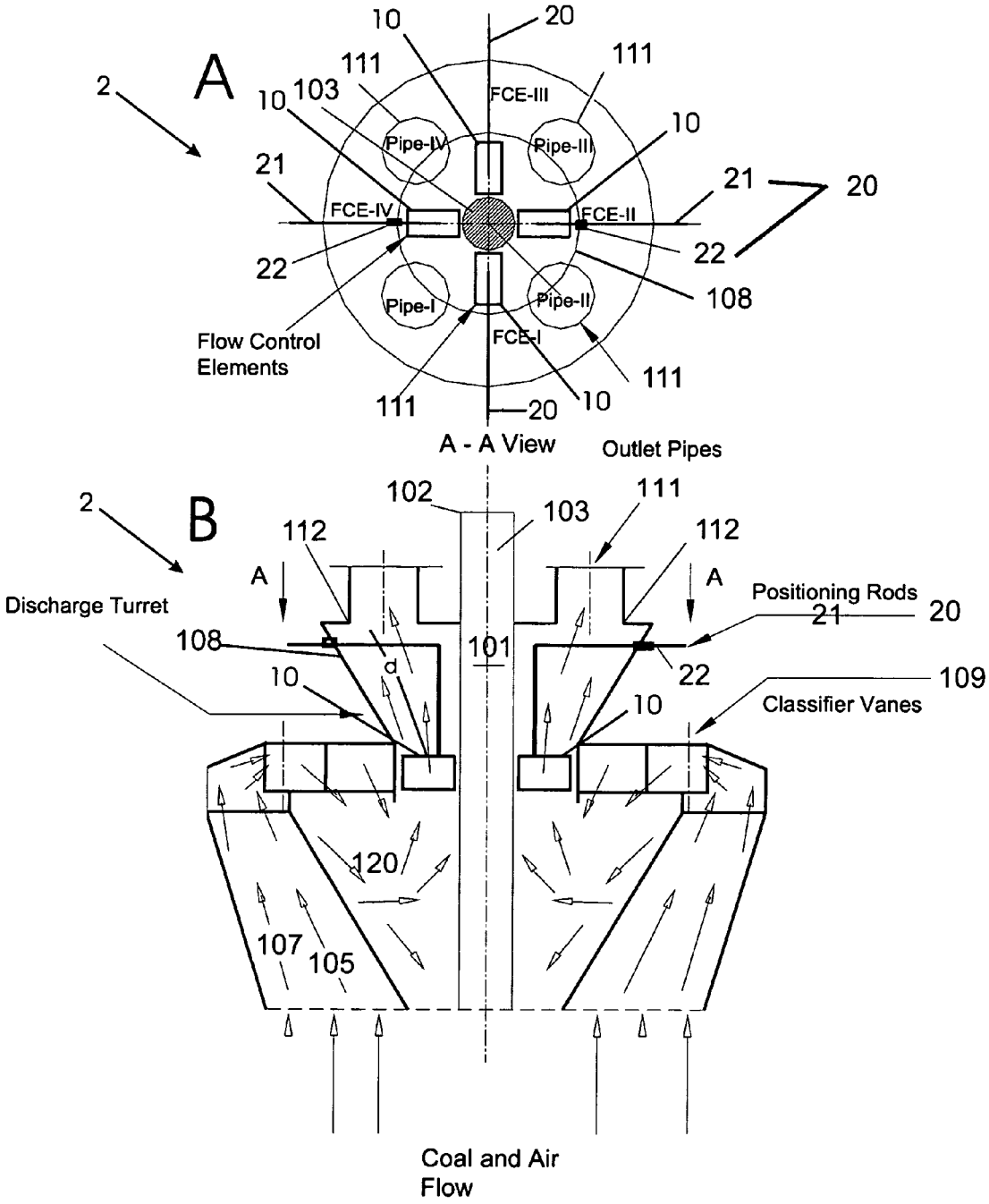
FIG. 2 Adjustable Flow Control Elements Installed Inside a Pulverizer with Four Outlet Pipes

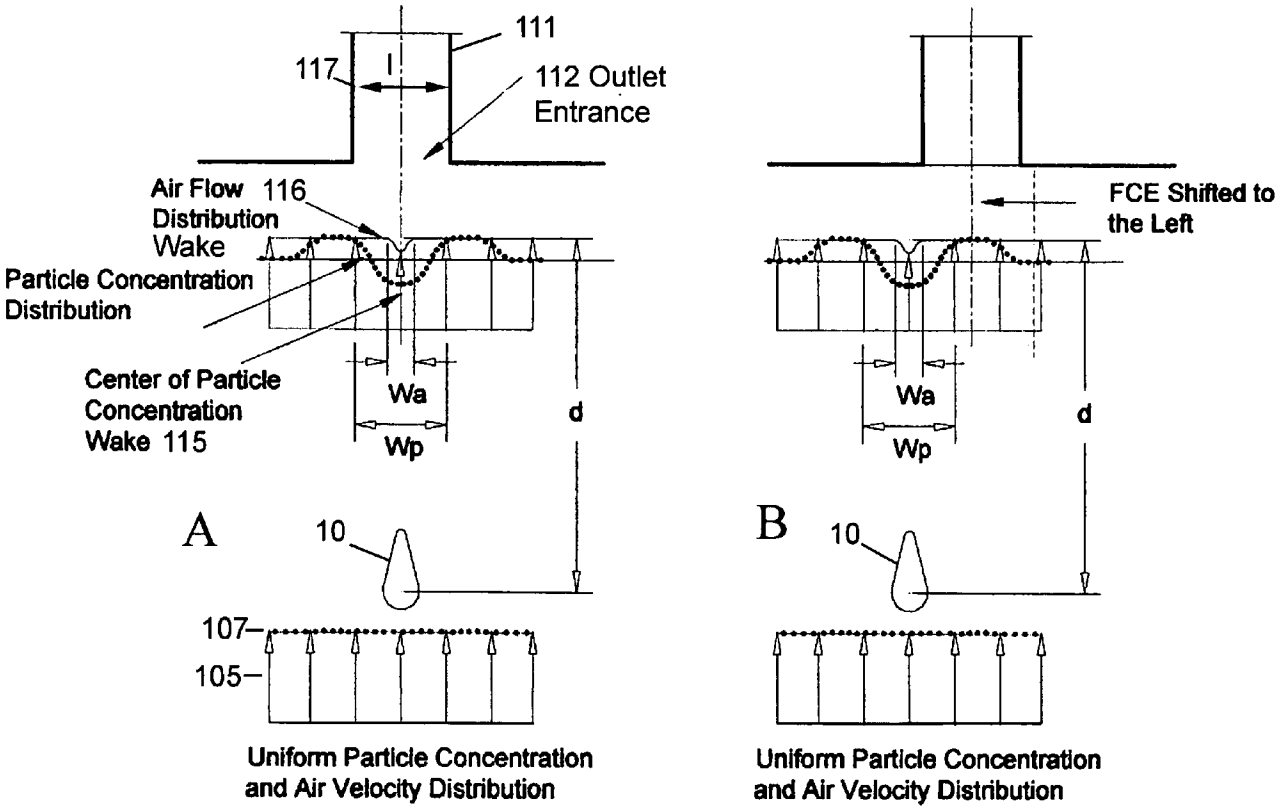
a) Decrease in Particle Flow Rate Through Pipe
b) Increase in Particle Flow Rate Through Pipe
FIG 3: Particle Concentration and Air Velocity Distributions Downstream of a Flow Control Element.

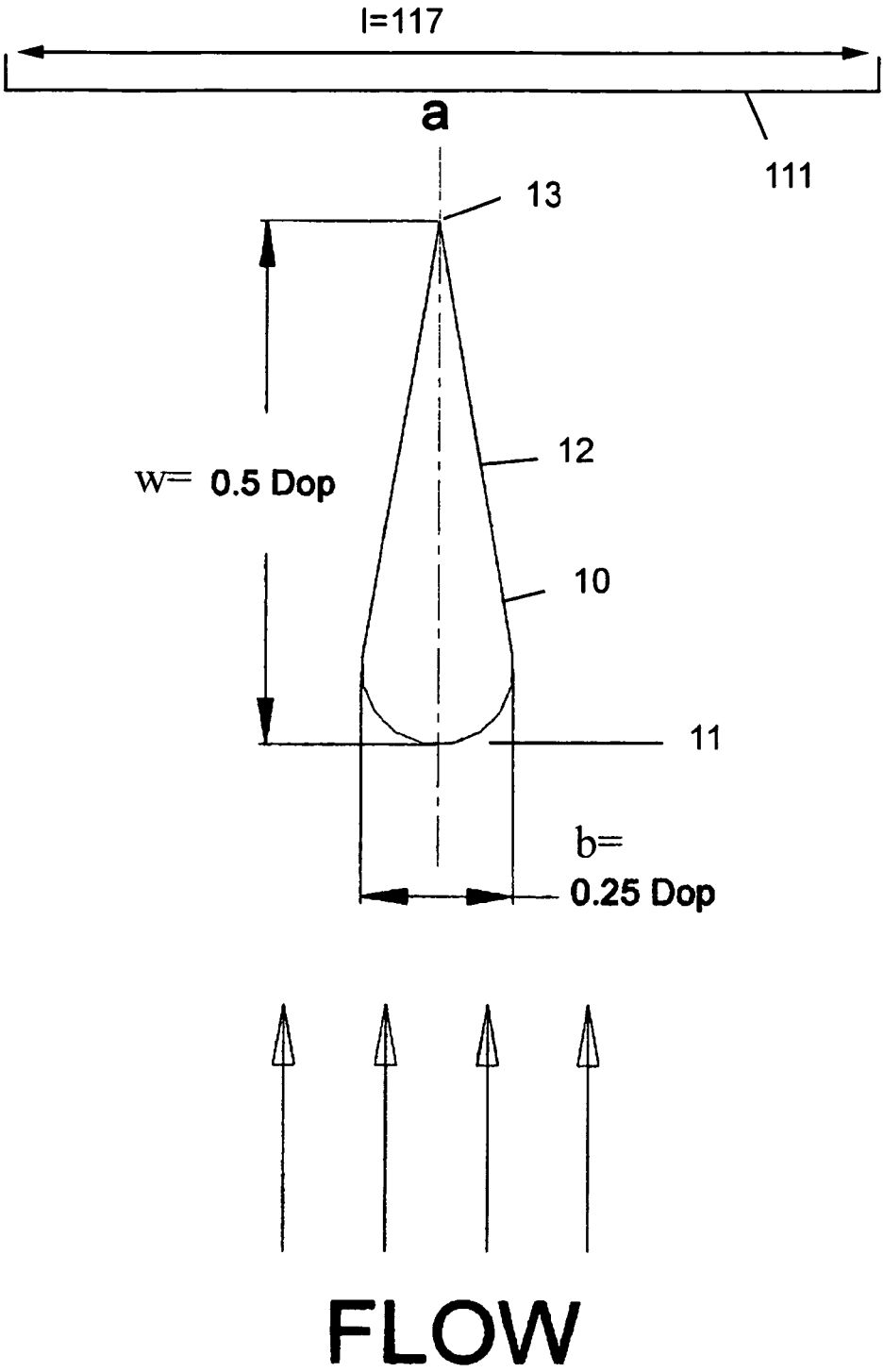
Dop : Outlet Pipe Diameter
FIG 4: Contour & Dimensions of Flow Control Element.

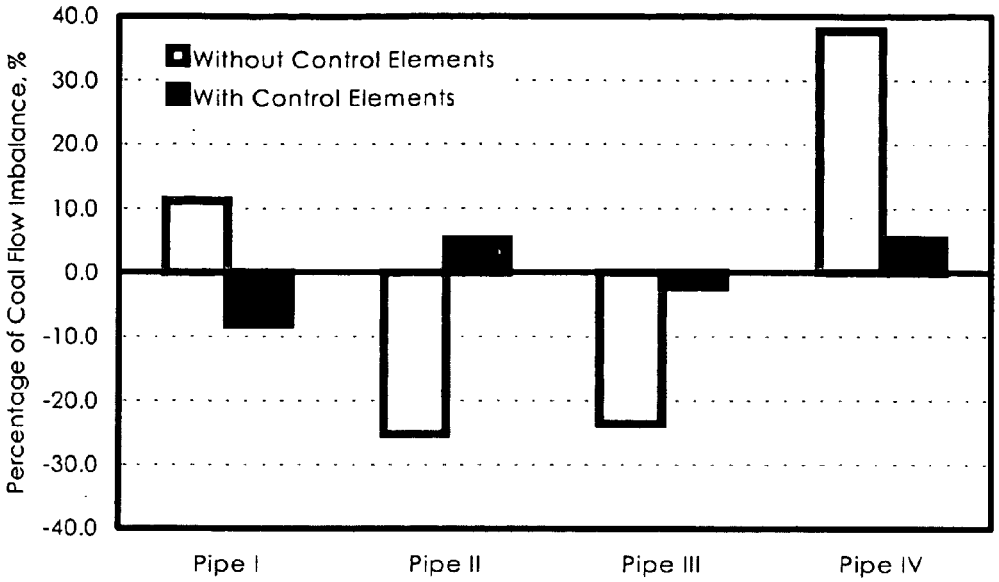
FIG 5: Balancing of Coal Flow Distribution with Flow Control Elements.
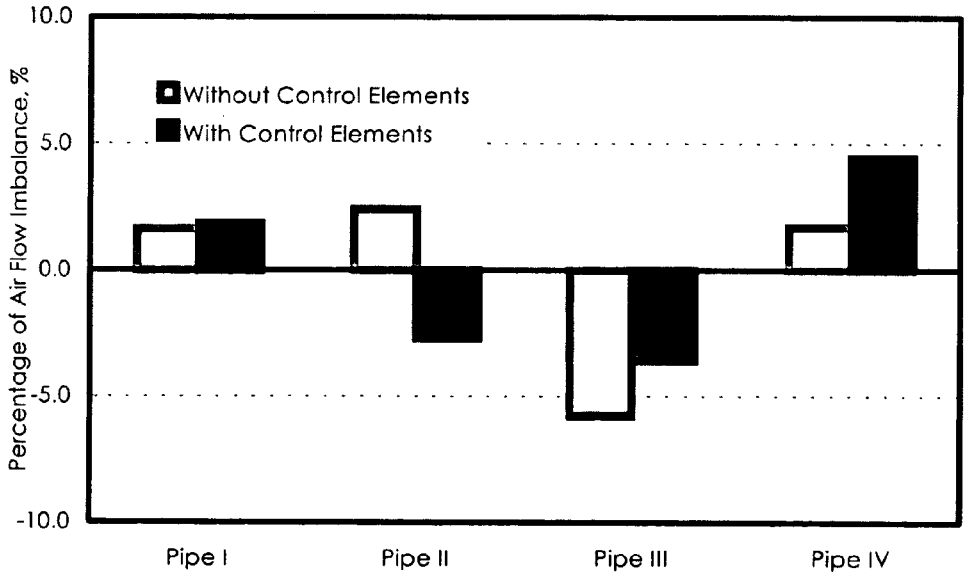
FIG 6: The Effect of Coal Flow Balancing with Flow Control Elements on Air Flow Distribution.

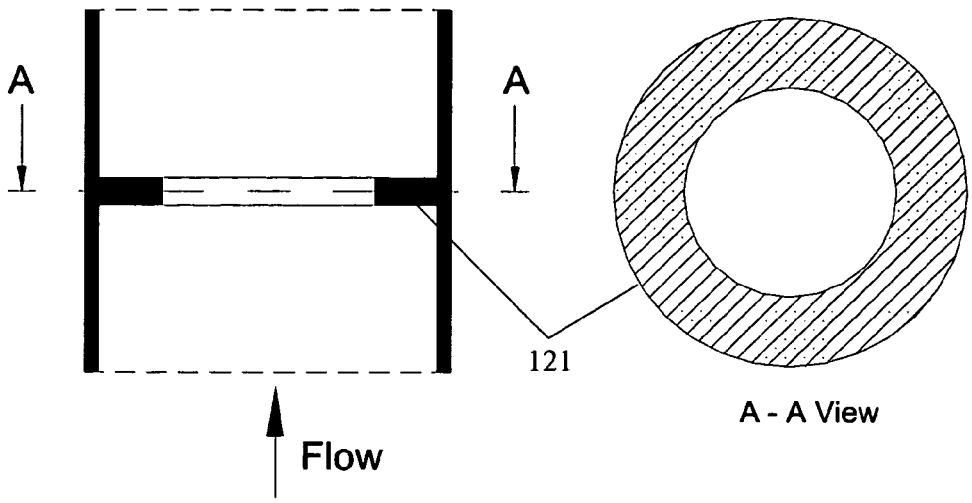
FIG. 7A Fixed Orifice Plate
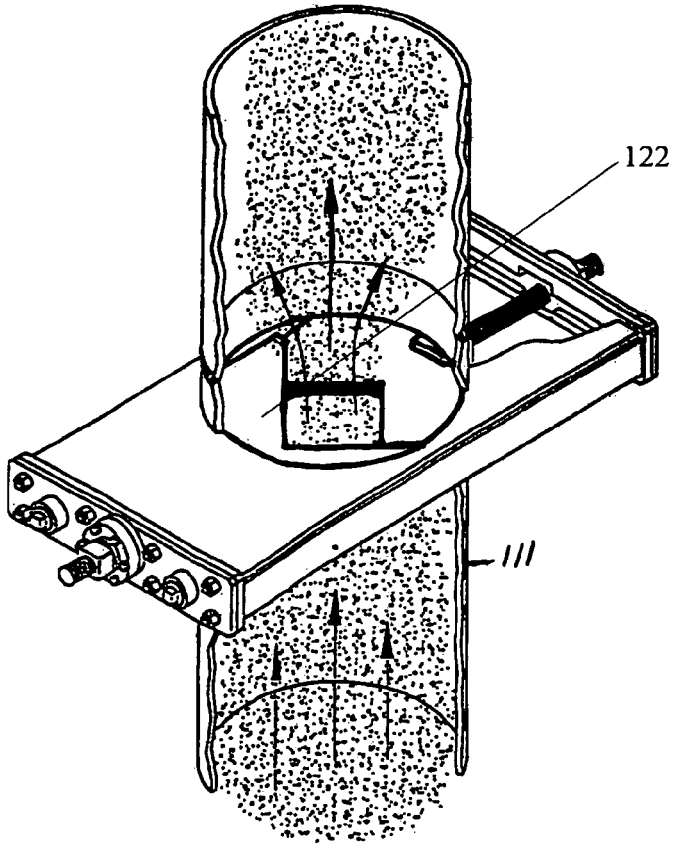
FIG. 7B Adjustable Orifice Plate

ON-LINE CONTROL OF COAL FLOW

CROSS-REFERENCE TO RELATED APPLICATIONS

The present application derives priority from U.S. Provisional Patent Application No. 60/436,241 for "ON-LINE CONTROL OF COAL FLOW IN PRESSURIZED VERTICAL SPINDLE MILLS" filed by Levy et al. on Dec. 23, 2002.

BACKGROUND OF THE INVENTION

1. Field of the Invention

The present invention relates to coal pulverizers and, more particularly, to the on-line control of the distribution of coal among the pulverized coal outlet pipes in pulverizers using independently adjustable flow control elements installed inside the pulverizer upstream of the entrance to each pulverized coal outlet pipe.

2. Description of the Background

Coal fired boilers utilize pulverizers to grind coal to a desired fineness so that it may be used as fuel for the boilers. Typically, raw coal is fed through a central coal inlet at the top of the pulverizer and falls by gravity to the grinding area. Once ground (different types of pulverizers use different grinding methods), the pulverized coal is transported upwards, using air as the transport medium. The pulverized coal passes through classifier vanes within the pulverizer. These classifier vanes may vary in structure, but are intended to establish a swirling flow within the rejects cone to prevent coarse coal particles from flowing into the discharge turret of the pulverizer. These vanes are often adjustable mechanisms. The centrifugal force field set up in the rejects cone forces the coarse coal particles to drop back down onto the grinding surface until the desired fineness is met. Once the coal is ground finely enough, it enters the discharge turret. From the discharge turret the pulverized coal is distributed among multiple pulverized coal outlet pipes and into respective fuel conduits where it is carried to the burners. Each coal pulverizer is an independent system and delivers fuel (pulverized coal) to a group of burners.

Poor balance of pulverized coal distribution between pulverized coal outlet pipes is commonly experienced in utility boilers. This can be due to various reasons, such as system resistance of each individual fuel conduit, physical differences inside the pulverizer, and coal fineness. Unbalanced distribution of coal among the pulverized coal outlet pipes adversely effects unit performance and leads to decreased combustion efficiency, increased unburned carbon in fly ash, increased potential for fuel line plugging and burner damage, increased potential for furnace slagging, and irregular heat release within the combustion chamber. In addition, it is critical for low $NO_x$ (Nitric Oxides) firing systems to precisely control air-to-fuel ratios in the burner zones to achieve low levels of $NO_x$ formation.

Therefore, there is a need in the industry for a method and apparatus that provides for on-line balance and control of the distribution of pulverized coal between the multiple pulverized coal outlet pipes of coal pulverizers.

SUMMARY OF THE INVENTION

Accordingly, it is the main object of the present invention to provide an improved method and apparatus for the on-line balancing and control of pulverized coal flow into the multiple pulverized coal outlet pipes of a coal pulverizer, thereby improving boiler performance by making it possible to operate the boiler with reduced pollutant levels (e.g. $NO_x$, CO) and increased combustion efficiencies.

It is another object of the present invention to provide an improved method and apparatus for the on-line balancing and control of pulverized coal flow from the discharge turret of a coal pulverizer into multiple pulverized coal outlet pipes and onto connected fuel conduits that does not disturb any pre-existing primary air flow balance among the multiple pulverized coal outlet pipes.

It is a further object of the present invention to provide an improved method and apparatus for the on-line balancing and control of pulverized coal flow from the discharge turret a coal pulverizer into multiple pulverized coal outlet pipes, where the type of pulverizer is a pressurized vertical spindle pulverizer. It is a further object of the present invention that the apparatus can be readily installed within an existing pressurized vertical spindle pulverizer without causing a significant pressure drop.

The objects of the present invention are accomplished by providing a device for balancing and control of pulverized coal distribution to multiple pulverized coal outlet pipes of a coal pulverizer. The device generally comprises a plurality of independently adjustable flow control elements and a means for adjusting the positioning of those flow control elements.

It is a further object of the present invention that each of the multiple flow control elements corresponds to an outlet pipe and controls the flow of pulverized coal into that particular corresponding outlet pipe.

It is a further object of the present invention that each of the multiple flow control elements is positioned within the discharge turret of the coal pulverizer at some appropriate distance upstream from the entrance to its corresponding pulverized coal outlet pipe.

Yet another object of the present invention is to provide a means for independently adjusting the positioning of each of the multiple flow control elements within the discharge turret and thereby, controlling the flow of pulverized coal to the corresponding outlet pipe.

It is a further object of this invention that each adjustment mechanism includes an independently adjustable rod seated in the top or side of the discharge turret of the coal pulverizer and connected to the flow control element for adjusting positioning of the flow control element horizontally or vertically.

The method of the present invention is practiced by monitoring either the pulverized coal flow at the individual pulverized coal outlet pipes or the individual flame characteristics, and then compensating for imbalances in the coal particulate flow or differences between flame characteristics by selectively adjusting the individual flow control elements as needed, thereby balancing and controlling the distribution of pulverized coal and improving combustion efficiency.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIGS. 1A and 1B are illustrations of an exemplary prior art coal pulverizer with multiple fuel conduits and a medial vertical cross section of this exemplary coal pulverizer, respectively FIGS. 2A and 2B are a horizontal cross section of the discharge turret and a medial vertical cross section of the pulverizer, respectively, of the preferred embodiment of the present invention.

FIGS. 3A and 3B each illustrate the particle concentration and air velocity distributions for a different positioning of an exemplary flow control element within a horizontal plane relative to the entrance to the corresponding pulverized coal outlet pipe.

FIG. 4 is a cross-section illustration of the air flow over an exemplary flow control element of the present invention.

FIG. 5 is a comparative graph showing the percentage of pulverized coal flow imbalance with and without the flow control elements in each outlet pipe.

FIG. 6 is a comparative graph showing the effect of coal flow balancing with and without the flow control elements on primary airflow distribution in each outlet pipe.

FIGS. 7A–B illustrate exemplary, fixed and adjustable, orifice plates.

DETAILED DESCRIPTION OF THE PREFERRED EMBODIMENT

In a conventional coal pulverizer 100 (as shown in FIGS. 1A–1B and FIG. 2) raw coal 101 is dropped into coal inlet port 102 and by force of gravity falls through coal chute 103 until it reaches the grinding mechanism 104. The grinding mechanism 104 grinds the coal into fine pieces. Air 105 flows into air inlet port 106 and transports the pulverized coal 107 upwards towards the inverted cone-shaped discharge turret 108. Typically, the pulverized coal 107 passes through a classifier vane mechanism 109 that establishes a swirling flow within the rejects cone 120. The centrifugal force field set up in the reject cone 120 prevents coarse pieces of coal 110 from entering the discharge turret 108. The coarse pieces of coal 110 fall by force of gravity back into the grinding mechanism 104. Once the pulverized coal 107 enters the discharge turret 108 it is distributed between the multiple equal diameter pulverized coal outlet pipes 111 (FIG. 1 indicates six pulverized coal outlet pipes 111). The pulverized coal 107 is then carried by connected fuel conduits to a boiler where it is burned as fuel.

As discussed above, poor balance of pulverized coal 107 distribution between pulverized coal outlet pipes 111 is commonly experienced in utility boilers. This can be due to various reasons, such as system resistance of each individual fuel conduit, physical differences inside the pulverizer, and coal fineness. The unbalanced distribution of coal among the pulverized coal outlet pipes adversely affects the unit performance and leads to decreased combustion efficiency, increased unburned carbon in fly ash, increased potential for fuel line plugging and burner damage, increased potential for furnace slagging, and non-uniform heat release within the combustion chamber. In addition, it is critical for low $NO_x$ (Nitric Oxides) firing systems to precisely control air-to-fuel ratios in the burner zones to achieve minimum production of $NO_x$. The relative distribution of coal between the pulverized coal outlet pipes is monitored by either measuring the concentration of pulverized coal flow at the individual pulverized coal outlet pipes or measuring the particular flame characteristics of burning fuel discharged from the each of the outlet pipes.

The method and apparatus of the present invention represent an improvement over the prior art of FIGS. 1A–B. Specifically, the invention described herein is a system, inclusive of method and apparatus, for the on-line balance and control of the flow of pulverized coal from the discharge turret of a coal pulverizer into its multiple pulverized coal outlet pipes. The preferred embodiment of the present invention is described herein for application in a conventional pressured vertical spindle mill type pulverizer (as shown in FIGS. 1A–B). This type of pulverizer operates at pressures above atmospheric pressure and employs a rotating horizontal grinding table and a multiplicity of grinding elements to pulverize the coal. Typically, pressurized vertical spindle mill type pulverizers have 3 to 8 pulverized coal outlet pipes 111. However, those skilled in the art will appreciate that this invention may be applied to other similarly structured vertical coal pulverizers of a type having a raw coal inlet port and chute, a coal grinding mechanism, air flow as a means for transporting pulverized coal, classifier vanes, a discharge turret and multiple pulverized coal outlet pipes connected to fuel conduits.

Referring to FIGS. 2A and 2B, the apparatus of the present invention comprises a plurality of individually adjustable flow control elements 10 located inside the discharge turret 108 of a coal pulverizer 2. The number of flow control elements 10 is equal to the number of pulverized coal outlet pipes 111 and each flow control element 10 corresponds to a particular pulverized coal outlet pipe 111. FIGS. 2A and B, show a pulverizer 2 with four outlet pipes 111. Each of the plurality of flow control element 10 is positioned inside the discharge turret 108 at some predetermined distance from the entrance 112 to the pulverized coal outlet pipes 111.

Generally, each flow control element 10 will be positioned in a horizontal plane at some point directly below (upstream of) the pulverized coal outlet pipes 111, allowing a free flow of pulverized coal into the outlet pipes 111. However, the horizontal and vertical positioning of each individual flow control element 10 may be adjusted by a flow control adjustment mechanism 20 to align the flow control element 10 to some degree in front of the entrance 112 to the corresponding pulverized coal outlet pipe 111 in order to decrease the flow of pulverized coal 107 into that particular outlet pipe 111.

The working principle of adjusting pulverized coal flow balance, by adjusting the positioning of the individual flow control elements 10 relative to the entrance 112 of the particular outlet pipes 111 is based upon creating a pulverized coal particle concentration wake 115 just upstream of each outlet pipe 111 that receives a relatively high pulverized coal particle flow rate (see FIGS. 3A and 3B). The distance (d) between the flow control elements 10 and the entrance to the outlet pipes 112 and the shape and dimensions of the flow control elements 10 are optimized in such a way that the distribution of pulverized coal 107 into the pulverized coal outlet pipes 111 is balanced while the effect of the flow control elements 10 on the primary air flow distributions 116 (See FIGS. 3A and B) is negligible. This balance improves boiler performance by increasing combustion efficiency, decreasing unburned carbon in fly ash, decreasing potential for fuel line plugging, burner damage and furnace slagging, and more uniformly releasing heat within the combustion chamber. The optimal distance for positioning the flow control elements within the discharge turret of a particular coal pulverizer must be determined by experimentation either in the field or in a laboratory setting or by mathematical calculations because different coal pulverizer designs have different internal proportions which effect both outflow coal and air distributions. This distance is proportional to the diameter of the outlet pipes. Similarly, the optimal shape and dimensions of the flow control elements also depend upon the internal proportions of the particular coal pulverizer. In practice, adjusting a flow control element such that it is positioned under the pulverized coal outlet pipe, decreases the flow of pulverized coal into the outlet pipe. Adjusting a flow control element such that it is shifted some distance to the side relative to the pulverized coal outlet pipe, increases the flow of pulverized coal into the outlet pipe.

FIGS. 3A and 3B illustrate the pulverized coal particle concentration and air velocity distributions, respectively, downstream of an exemplary streamlined flow control element 10 for two different positions of the flow control element. Since the pulverized coal particles 107 have more inertia than the air, the particle concentration wake (Wp) 115 is considerably wider than the air flow distribution wake (Wa) 116 at the entrance 112 to the corresponding outlet pipe 111. When a flow control element 10 is adjusted such that the center of the pulverized coal particle concentration wake 115 is lined up with the outlet pipe centerline, a reduction in pulverized coal particle flow into the corresponding pipe occurs (FIG. 3A). On the other hand, when the flow control element is adjusted so that it is positioned to one side of the outlet pipe 111, the highly concentrated particle flow stream created at the edge of the particle concentration wake is directed towards the entrance 112 of the of the corresponding outlet pipe 111 resulting in an increase in pulverized coal flow 107 into the outlet pipe (FIG. 3B). Since each flow control element 10 is independently adjustable, the coal flow rates in each pipe can be adjusted using techniques similar to that explained above.

Those skilled in the art will recognize that a variety of adjustment mechanisms 20 are suitable for supporting the individual flow control elements 10 within the discharge turret 108 and for easily accessible on-line adjusting of the position of those flow control elements 10 in relation to the outlet pipes 111. For example, as shown in FIG. 2A, the flow control elements 10 may each be connected to and supported by a straight support rod 21 which in turn is supported by and mounted in sealed bushings 22 on the discharge turret 108. In this configuration, individually adjusting each straight support rod 21 by sliding it back and forth or rotating it causes a change in the position of the corresponding flow control element 10 inside the discharge turret 108, thereby resulting in a shift in coal flow to the outlet pipe 111. Similarly, FIG. 2B illustrates the adjustment mechanism 20 in which the each flow control element 10 is connected to and supported by an orthogonal support rod 21. The orthodongal support rod 21 is supported by and mounted in bushings 22. Again, individually adjusting the orthogonal support rods 21 by sliding them back and forth or rotating them within the bushings 22 causes a change in the position of the corresponding flow control element 10 inside the discharge turret 108, thereby resulting in a shift in coal flow to the outlet pipe 111.

The shape and dimensions of the flow control elements 10 and the distance between the flow control elements 10 and the outlet pipes 111 are important parameters in outfitting a particular coal pulverizer with the present invention. Specifically, the flow control elements 10 must be positioned within the discharge turret 108 a sufficient predetermined distance from the pulverized coal outlet pipes 111 such that they have a negligible effect on the distribution of primary air flow while coincidentally having a significant effect on the distribution of pulverized coal. The primary air flow distribution 116 should not be disturbed because in most boilers primary air flow is balanced by the use of orifice-type restrictors in the individual pulverized coal outlet pipes 111. Thus, if primary air flow distribution 116 was disturbed, air flow would have to be re-balanced whenever a flow control element 10 was adjusted. The shape of the flow control elements 10 likewise affects the distribution of primary air flow.

To determine the preferred shape of the flow control elements 10 and the preferred distance from the entrance 112 to pulverized coal outlet pipe 111 to position the flow control elements 10, the inventors conducted a series of quantitative experiments. These experiments were conducted on a laboratory scale pressurized vertical spindle mill type pulverizer having four outlet pipes and configured with air foil shaped flow control elements 10 (as shown in FIGS. 3A–B and 4). During the experiments both the distribution of pulverized coal into the individual pulverized coal outlet pipes 111 and primary air flow was monitored. The results indicated that positioning the flow control elements within the discharge turret at a distance upstream of the entrance 112 to the pulverized coal outlet pipes approximately equal to two times the outlet pipe diameter 117 induces a wide downstream pulverized coal flow wake 115 relative to the primary air flow distribution wake 116, thereby providing an efficient method for controlling the distribution of pulverized coal flows among the outlet pipes while having a negligible effect on air flow distribution.

Additionally, referring to FIG. 4, these experiments indicated that flow control elements 10 having a streamlined cross-section comprising a convex, rounded windward end 11, smooth tapering sides 12 and a pointed leeward end 13 (i.e. an air foil shape), wherein the diameter of the rounded windward end 11 is approximately equal to one-quarter the diameter 117 of the pulverized coal outlet pipe 111 and the length of the flow control element 10 is approximately equal to one half the diameter 117 of the pulverized coal outlet pipe 111, were found to provide close control over the distribution of pulverized coal flow with negligible impact on air flow distribution. This streamlined design allows both the pulverized coal and air to flow easily over the flow control elements 10 towards the outlet pipes 11. The flow of coal over this streamlined shape creates a wider coal particle concentration wake 115 than that of the primary air flow wake 115. In other words, the effect to the primary air flow is negligible. It should be understood to one skilled in the art that other streamlined configurations for the flow control elements will suffice and provide similar satisfactory results.

Therefore, in order to practice the method of the present invention and configure the device of the present invention to a particular pulverizer the distance of the flow control elements 10 from the outlet pipes 111 and the dimensions and cross sectional shape of the flow control elements 10 should be predetermined by testing and cataloging the results for that pulverizer, or by a more refined mathematical approach based upon the results of the experiments herein describe, in light of the different dimensions and internal configuration of the particular pulverizer. However, based upon the above-described experiments a user should start with a streamlined coal flow element with a frontal diameter and length of one quarter and one half, respectively, of the diameter of the outlet pipes. The flow control element should be positioned a distance upstream from the outlet pipes within the discharge turret of approximately twice the diameter of the outlet pipes. Then, this configuration should be subjected to trial-and-error adjustments.

One skilled in the art will appreciate that while the above-described positioning of the flow control elements and the shape and dimensions of the flow control elements were made with reference to a pressurized vertical spindle pulverizer with four pulverized coal outlet pipes, depending on the configuration of the particular pulverizer, a variety of flow control element positions and flow control element shapes and dimensions are considered to be within the scope and spirit of the present invention.

For example, one skilled in the art will recognize that for a vertical spindle pulverizer with three outlet pipes, the spacing between outlet pipes is greater than with a four outlet pipe pulverizer and thus the distance between the entrance to the outlet pipes and the flow control elements and the shape and dimensions of the flow control elements might require adjusting in order to minimize the effect on the distribution of primary air flow while maximizing the effect on the pulverized coal flow distribution. Similarly, a coal pulverizer with more than four outlet pipes will result in less of a physical separation between outlet pipes and engender further adjustment of the distance between the entrance to the outlet pipes and the flow control elements and/or the shape and dimensions of the flow control elements.

FIG. 5 is a comparative graph of the results of the above-mentioned experiments showing the percentage of pulverized coal flow imbalance when the pulverizer was configured both with and without the flow control elements 10.

FIG. 6 is a comparative graph of the results of the above-mentioned experiments showing the effect on primary airflow distribution when the pulverizer was configured both with and without the flow control elements 10. As can be seen in FIGS. 5 and 6, a thirty-five percent change in coal flow rate was achieved with the flow control elements (FIG. 5) while the maximum change in the primary airflow was less than 5 percent (FIG. 6). Thus, the individually adjustable flow control elements 10 positioned inside the discharge turret of the pulverizer 2, will succeed in balancing the distribution of coal and improving the overall performance via increased combustion efficiency, decreased unburned carbon in fly ash, decreased potential for fuel line plugging, burner damage and furnace slagging, and more uniform heat release within the combustion chamber. Furthermore, the primary airflow rate in the individual outlet pipes 111 can be balanced by including fixed orifice flow restrictors 121 or adjustable orifice flow restrictors 122 inside the outlet pipes 111, as shown in FIGS. 7A and 7B, respectively. These orifice flow restrictors 121, 122 are well-known in the art and if used in combination with the individually adjustable flow control elements 10, boiler operators will have even greater control over burner balance. The aforesaid combination is considered to be within the scope and spirit of the present invention.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. In a vertical coal pulverizer having a discharge turret and plurality of pulverized coal outlet pipes in said discharge turret, a device for balancing and controlling the distribution of pulverized coal into the plurality of outlet pipes comprising:

a plurality of adjustable flow control elements positioned within said discharge turret of said pulverizer, each of said plurality of flow control elements corresponding to one of said plurality of outlet pipes and being spaced there from, a corresponding plurality of adjustment mechanisms for each of said plurality of flow control elements for adjusting the position of the flow control element relative to said corresponding outlet pipe.

2. The device for balancing and controlling the distribution of pulverized coal into the plurality of outlet pipes of claim 1, wherein the shape of each flow control element is aerodynamic to induce a wide coal particle concentration wake and a narrow primary air flow wake relative to said coal particle concentration wake.

3. The device for balancing and controlling the distribution of pulverized coal into the plurality of outlet pipes of claim 2, wherein said plurality of flow control elements are each positioned an equal predetermined distance upstream of the entrance to said outlet pipes.

4. The device for balancing and controlling the distribution of pulverized coal into the plurality of outlet pipes of claim 3, wherein said predetermined distance comprises a function of the diameter of said outlet pipes and the structure and configuration of said pulverizer including the number of outlet pipes.

5. The device for balancing and controlling the distribution of pulverized coal into the plurality of outlet pipes of claim 2, wherein said each of said aerodynamic flow control elements comprises a convex rounded windward end, smooth tapering sides and a pointed leeward end.

6. The device for balancing and controlling the distribution of pulverized coal into the plurality of outlet pipes of claim 5, wherein the convex rounded windward end has a diameter that is a function of the diameter of said outlet pipes and the structure and configuration of said pulverizer including the number of outlet pipes.

7. The device for balancing and controlling the distribution of pulverized coal into the plurality of outlet pipes of claim 6, wherein said flow control elements have a length that is a function of the diameter of said outlet pipes and the structure and configuration of said pulverizer including the number of outlet pipes.

8. The device for balancing and controlling the distribution of pulverized coal into the plurality of outlet pipes of claim 1, wherein each of said flow control elements is mounted on and supported by said corresponding adjustment mechanism, and said corresponding adjustment mechanism allows for independent adjustments of the position of each flow control element relative to the center point of said corresponding outlet pipe in order to selectively vary the particle concentration wake to alter the concentration of the pulverized coal flow into the corresponding outlet pipe, the closer the flow control element is to being aligned with the center point of the outlet pipe, the lesser the concentration of the pulverized coal flowing into the outlet pipe.

9. The device for balancing and controlling the distribution of pulverized coal into the plurality of outlet pipes of claim 8, wherein each of the plurality of adjustable flow control elements is pre-positioned inside said discharge turret of said pulverizer at said predetermined distance upstream of the entrance to said outlet pipes allowing a free flow of pulverized coal into the outlet pipes; and wherein the position of each of the plurality of adjustable flow control elements may be adjusted from said preposition using said adjustment mechansim.

10. The device for balancing and controlling the distribution of pulverized coal into the plurality of outlet pipes of claim 9, wherein said adjustment mechanism is accessible on-line from outside said pulverizer.

11. The device for balancing and controlling distribution of pulverized coal into the plurality of outlet pipes of claim 10, wherein each adjustment mechanism is comprised of a support rod attached to a corresponding flow control element; each of said support rods is further mounted in a sealed bushing in the discharge turret such that each rod is accessible on-line from outside said pulverizer and may be rotated or slid back and forth within its bushing to adjust the position of the attached flow control element relative its corresponding outlet pipe.

12. The device for balancing distribution of coal among the outlet pipes according to claim 1, further comprising a plurality of orifice flow restrictors each located in a corresponding outlet pipe.

13. The device for balancing and controlling distribution of pulverized coal into the plurality of outlet pipes of claim 5, wherein said pulverizer is a pressurized vertical spindle pulverizer with four pulverized coal outlet pipes, the diameter of the convex rounded windward end of said flow control elements is approximately equal to one-quarter the diameter of said pulverized coal outlet pipes, the length of said flow control elements is approximately equal to one half the diameter of the pulverized coal outlet pipes and the distance between the entrance to each of the four outlet pipes and its corresponding flow control element is optimal at approximately two times the outlet pipe diameter.

14. In a vertical coal pulverizer that produces pulverized coal for use as boiler fuel of a type having a raw coal inlet port and chute, a coal grinding mechanism, primary air flow as a means for transporting pulverized coal, a discharge turret and a plurality of pulverized coal outlet pipes of equal diameter, a method for balancing and controlling the distribution of pulverized coal into the plurality of outlet pipes and thereby improving boiler performance; said method comprising the steps of: monitoring distribution of pulverized coal flow into each of said outlet pipes relative to primary air flow; and compensating for imbalances in said pulverized coal flow into said outlet pipes by positioning flow control elements corresponding to each outlet pipe a predetermined distance upstream from said outlet pipes and selectively adjusting the individual flow elements on-line in order to alter the rate of pulverized coal flow into said corresponding outlet pipes.

15. The method of claim 14, wherein the step of monitoring distribution of pulverized coal flow into each of said outlet pipes relative to a primary air flow is accomplished by measuring a concentration of pulverized coal flow at the individual pulverized coal outlet pipes.

16. The method of claim 14, wherein the step of monitoring distribution of pulverized coal flow into each of said outlet pipes relative to primary air flow is accomplished by measuring particular flame characteristics of burning fuel discharged from the each of the outlet pipes.

17. The method of claim 14, wherein adjusting a flow control element is accomplished by selectively changing the position of the flow control element relative to the center point of the entrance to its corresponding outlet pipe, the closer the flow control element is to being aligned with the center point of the outlet pipe, the lesser the concentration of the pulverized coal flowing into the outlet pipe.

* * * * *